US006744339B2

(12) United States Patent
Daehler et al.

(10) Patent No.: US 6,744,339 B2
(45) Date of Patent: Jun. 1, 2004

(54) MOTOR PROTECTION TRIP UNIT

(75) Inventors: Christian Daehler, Avon, CT (US); Biranchi Sahu, Orissa (IN); Varma S P Dantuluri, Secunderabad AP (IN); Tom O'Keeffe, Southlake, TX (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/095,637

(22) Filed: Mar. 12, 2002

(65) Prior Publication Data

US 2003/0174033 A1 Sep. 18, 2003

(51) Int. Cl.[7] ..... H01H 75/12
(52) U.S. Cl. ..... 335/35; 335/38
(58) Field of Search ..... 335/23–25, 35–42, 335/166–176

(56) References Cited

U.S. PATENT DOCUMENTS 4,725,800 A * 2/1988 Grunert et al. ..... 335/38
4,771,254 A 9/1988 DiVincenzo
5,670,922 A * 9/1997 Montague et al. ..... 335/172
6,104,109 A 8/2000 Sato
6,218,920 B1 4/2001 Reichard et al.
6,239,677 B1 5/2001 Ramakrishnan et al.
6,262,645 B1 7/2001 McNeil et al.
6,281,458 B1 8/2001 Castonguay et al.
6,556,111 B2 * 4/2003 Felden et al. ..... 335/172

* cited by examiner

*Primary Examiner*—Lincoln Donovan
(74) *Attorney, Agent, or Firm*—Karl A. Vick, Esq.; Armstrong Teasdale LLP

(57) ABSTRACT

A motor protection trip unit for a circuit breaker includes an electrically conductive strap, a yoke including a body including a first side wall, a second side wall, a third side wall, and a fourth side wall. The third side wall extends between the first and second side walls, the fourth side wall extending from the first and second side walls and comprising a yoke gap extending therethrough. A motor protection trip unit for a circuit breaker also includes a flapper holder coupled to the strap, a flapper pivotally coupled to the flapper holder, and a biasing mechanism coupled between the flapper holder and the flapper. The biasing mechanism is configured to maintain the flapper a distance from the yoke such that a yoke-flapper gap is defined between the yoke and the flapper.

18 Claims, 3 Drawing Sheets

MOTOR PROTECTION TRIP UNIT

BACKGROUND OF THE INVENTION

This invention relates generally to circuit breakers, and more particularly, to motor circuit breakers including a magnetic trip unit.

Circuit breakers are used to provide protection against very high currents produced by short circuits. At least some known circuit breakers include trip units which include a rotationary stator-armature system and a stator-flapper gap system. The stator-flapper gap system is variable to control a gap within the trip unit to facilitate overcurrent trip protection for different trip settings. More specifically, because a magnitude of a low current setting is smaller than that of a high current setting, the gap is defined more narrowly for low current protection, and larger for higher current protection.

To accomplish varying the gap, flapper return springs are used in an arrangement such that the restoring moment is increasing with a decreasing gap. However, because the spring force may diminish over time, accurate repeatability of such a flapper return system may diminish. Eventually, continued operation of such a return spring system may cause a disengagement of the latching system, thus increasing a potential of unnecessary motor trips. Furthermore, because of space considerations, the air gap may not be defined wide enough to satisfy the initial desired high current settings, and as such, the circuit breaker may trip at a lower current setting that desired.

BRIEF DESCRIPTION OF THE INVENTION

In one aspect, a motor protection trip unit for a circuit breaker includes an electrically conductive strap, a yoke including a body including a first side wall, a second side wall, a third side wall, and a fourth side wall. The third side wall extends between the first and second side walls, the fourth side wall extending from the first and second side walls and comprising a yoke gap extending therethrough. A motor protection trip unit for a circuit breaker also includes a flapper holder coupled to the strap, a flapper pivotally coupled to the flapper holder, and a biasing mechanism coupled between the flapper holder and the flapper. The biasing mechanism is configured to maintain the flapper a distance from the yoke such that a yoke-flapper gap is defined between the yoke and the flapper.

In another aspect, a circuit breaker includes a motor protection trip unit including a yoke, a flapper, and a conductive strap. The trip unit including the conductive strap extending therefrom and proximate to the flapper, the flapper and the yoke coupled to the trip unit, the yoke including four side walls defining a yoke gap, the flapper configured to rotate independently of the trip unit to selectively adjust a gap defined between the yoke and flapper. The trip unit also includes a contact arm configured to engage the conductive strap, a latching assembly coupled to the contact arm, a tripping assembly rotatable about an axis of symmetry and configured to engage the latching mechanism for tripping the circuit breaker during an overcurrent condition.

In another aspect, a method of operating a motor is provided. The method includes providing a rated current to the motor through a circuit breaker that includes a tripping assembly, sensing a low current three times rated current and a high current of twenty times rated current with a motor protection trip unit that is coupled to the circuit breaker and the tripping assembly, and tripping the motor protection trip unit when an overcurrent condition is sensed such that current flow to the motor is prevented.

DETAILED DESCRIPTION OF THE INVENTION

Figure 1:
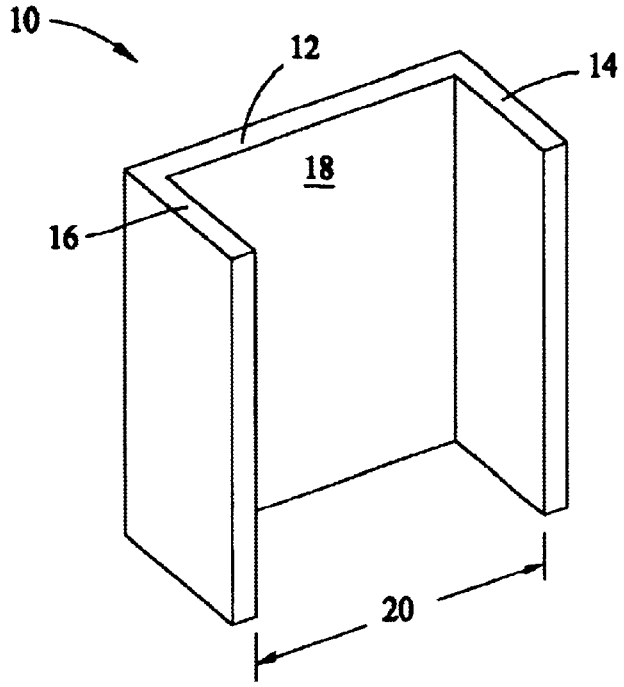
Prior Art FIG. 1
FIG. 1 is a perspective view of a known yoke for use with a motor protection trip unit.

FIG. 1 is a perspective view of a known yoke 10 for use with a motor protection trip unit (not shown). Yoke 10 includes a body 12, a first side 14, and a second side 16. First and second sides 14 and 16, respectively, extend substantially perpendicularly from a front side 18 of body 12 such that a yoke gap 20 is defined between first and second sides 14 and 16, respectively.

Figure 2:
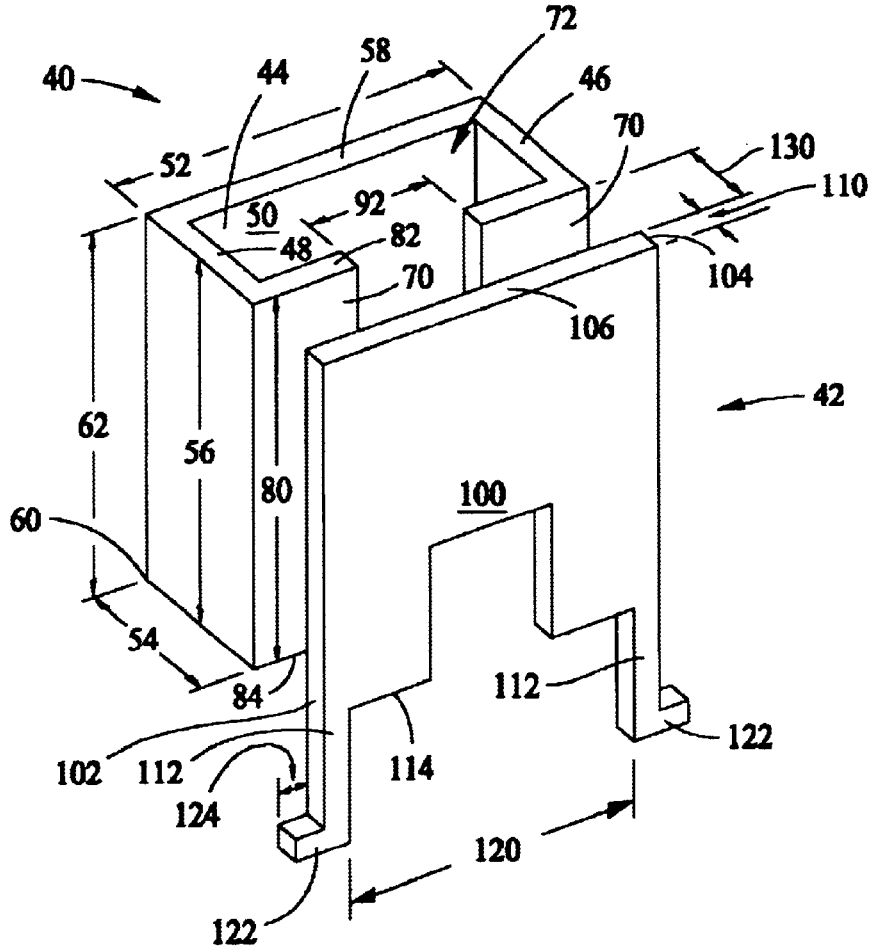
FIG. 2 is a perspective view of a motor protection trip unit yoke and a flapper.

FIG. 2 is a perspective view of a yoke 40 and a flapper 42 for use with a motor protection trip unit (not shown in FIG. 2). Yoke 40 has a body 44, a first sidewall 46, and a second sidewall 48. In one embodiment, yoke 40 is fabricated from a metallic material. Sidewalls 46 and 48 are substantially parallel to each other, and extend substantially perpendicularly from a front side 50 of body 44 to define a width 52 for yoke 40. Yoke 40 also has a length 54 measured with respect to sidewalls 46 and 48. In the exemplary embodiment, sidewalls 46 and 48 are identical, and each has a height 56 measured between an upper surface 58 and a lower surface 60 of each sidewall. More specifically, sidewall height 56 is approximately equal a height 62 of body 44. In one embodiment, yoke 40 is formed from a single plate. In an alternative embodiment, yoke 40 is formed from a plurality of plates coupled together.

Yoke first and second sidewalls 46 and 48, respectively, extend to a third sidewall 70. More specifically, sidewall 70 extends substantially perpendicularly from each sidewall 46 and 48, such that a cavity 72 is defined by sidewalls 46, 48, and 70, and body 44. In the exemplary embodiment, third sidewall 70 is substantially parallel to body 44 such that yoke 40 and cavity 72 have a substantially rectangular cross-sectional profile. In an alternative embodiment, yoke 40 is substantially T-shaped. In a further embodiment, yoke 40 is substantially square-shaped.

Third sidewall 70 has a height 80 that is measured between an upper surface 82 and a lower surface 84 of sidewall 72. Third sidewall height 80 is approximately equal that of first and second sidewall height 56 and body height 62. Third sidewall 70 includes a gap 90 that extends between upper and lower surfaces 82 and 84, respectively. In the exemplary embodiment, gap 90 extends substantially perpendicularly through sidewall 70 with respect to surfaces 82 and 84. Gap 90 has a width 92 that is selected based on the motor protection trip unit requirements. More specifically, an overall size of yoke 40 is selected based on the motor protection trip unit requirements.

Flapper 42 includes a body 100 having a first side 102, a second side 104 and an upper surface 106 extending therebetween. In the exemplary embodiment, sides 102 and 104 are substantially parallel, and surface 106 is substantially perpendicular with respect to sides 102 and 104. Sides 102 and 104 define a width 110 of flapper 42 that is approximately equal yoke width 52. Flapper width 110 is selected based on the motor protection trip unit requirements. In one embodiment, flapper 42 is fabricated from the same material used in fabricating yoke 40. In another embodiment, flapper 42 is fabricated from stainless steel. In the exemplary embodiment, flapper body 100 is substantially rectangular.

Flapper 42 also includes a pair of arms 112 extending substantially perpendicularly from a lower surface 114 of flapper body 100. Arms 112 are identical and define a gap 116 therebetween. Gap 116 has a width 120 that is larger than yoke gap width 92. Gap width 120 is variably selected based on motor protection trip unit requirements.

A pair of hinge pins 122 extend radially outwardly from arms 112. More specifically, each pin 122 is substantially perpendicular with respect to each respective arm 112, and extends a distance 124 from each respective arm 112. Pins 122 enable flapper 42 to be pivotally coupled within the motor protection trip unit such that a variable yoke-flapper gap 130 is defined between flapper 42 and yoke 40 when yoke 40 and flapper 42 are installed within the motor protection trip unit.

Figure 3:
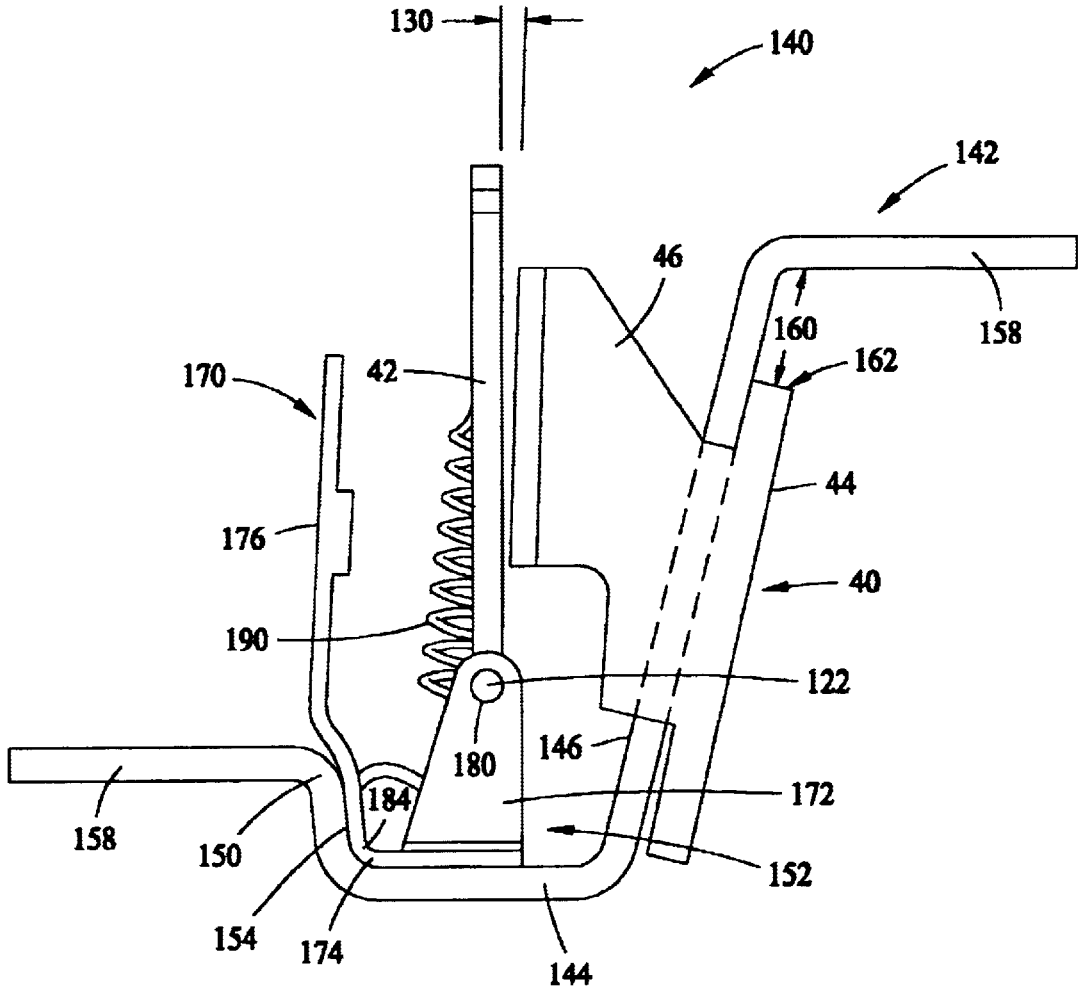
FIG. 3 is a side view of a motor protection trip unit including the yoke and flapper shown in FIG. 2.

FIG. 3 is a side view of a motor protection trip unit 140 including yoke 40 and flapper 42. In the exemplary embodiment, motor protection trip unit 140 is a magnetic trip unit. Motor protection unit 140 also includes an electrically conductive strap 142. Strap 142 has a substantially rectangular cross-sectional profile, and includes a base 144 and a wall 146 extending outwardly from base 144. In the exemplary embodiment, strap 142 includes a plurality of apertures (not shown) used to variably position yoke 40 and flapper 42 within motor protection unit 140. In one embodiment, strap 142 is fabricated from a single plate. Alternatively, strap 142 is fabricated from a plurality of members coupled together.

Strap base 144 includes an elbow 150 such that a recess 152 is defined between elbow 150 and forward wall 146. In one embodiment, wall 146 extends substantially perpendicularly from base 144 such that elbow 150 includes a recess wall 154 that is substantially parallel to wall 146. Strap 142 also includes a wall portion 158 that extends substantially perpendicularly away from wall 146 and away from recess 152. In one embodiment, wall portion 158 is substantially parallel base 144.

Strap 142 extends through yoke cavity 72 (shown in FIG. 2) between sidewalls 46 and 48 (shown in FIG. 2). Specifically, strap 142 is positioned substantially flush against body front side 50, such that strap forward wall portion 146 extends from yoke cavity 72, and is a distance 160 from an upper surface 162 of yoke body 44. More specifically, yoke body 44 is coupled to strap 142 with, but not limited to, at least one of a weld, a screw, and a rivet.

Flapper 42 is coupled to strap base 144 with a flapper holder 170. Flapper holder 170 includes a pair of identical hinges 172, a base 174, and an extension 176. Base 174 is coupled to strap base 144 within strap recess 152. In one embodiment, base 174 is coupled to strap base 144 using, but not limited to, a weld, a rivet, and a screw. Each hinge 172 extends from base 174 such that each hinge 172 is substantially perpendicular with respect to strap base 144 within strap recess 152. Each hinge 172 includes an opening 180 sized to receive flapper 42 therein. More specifically, each hinge portion opening 180 receives a respective flapper hinge pin 122 therein, such that flapper 42 is pivotally coupled to strap 142.

Flapper holder extension 176 substantially perpendicularly from flapper holder hinge 172 and provides structural support for flapper holder 170. Furthermore, extension 176 includes an elbow portion 184 that enables extension 176 to be braced substantially flush against strap base elbow 150.

A biasing mechanism 190 extends between flapper holder 170 and flapper 42. In the exemplary embodiment, mechanism 190 is a spring. Mechanism 190 is biased between flapper 42 and flapper holder 170 such that flapper 42 is maintained at a predetermined yoke-flapper gap 130. More specifically, mechanism 190 is biased towards flapper holder extension 176 and away from yoke 40 such that as flapper 42 rotates away from yoke 40, the yoke-flapper gap 130 increases and the amount of torsional force induced to flapper 42 is substantially increased.

In use, motor protection unit 140 is electrically coupled to a motor circuit breaker unit (not shown in FIG. 3). As an overcurrent passes through strap 142 to yoke 40 and flapper 42, a magnetic flux is generated within yoke gap 90. The magnetic flux increases as the current increases, and yoke-flapper gap 130 is varied in response to movements of flapper 42. More specifically, as the magnetic flux increases, flapper 42 is rotated in opposition to mechanism 190 towards yoke 40 about hinges 172.

Figure 4:
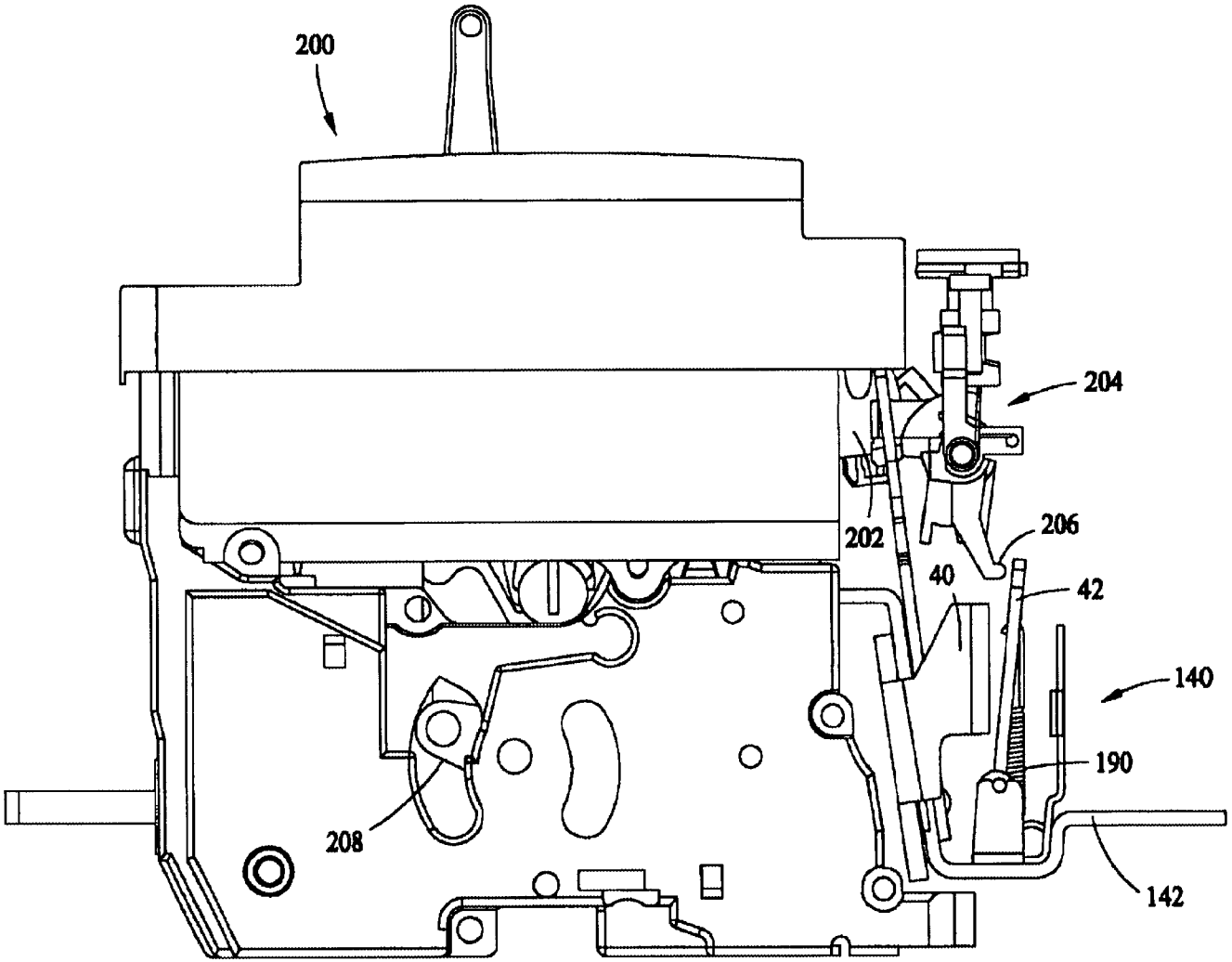
FIG. 4 is a side view of a circuit breaker with the motor protection trip unit from FIG. 3.

FIG. 4 is a side view of a motor circuit breaker 200 including motor protection trip unit 140 from FIG. 3. Circuit breaker 200 includes a latching assembly 202 and a tripping assembly 204. Tripping assembly 204 actuates latching assembly 202. Motor trip unit 140 is in operational contact with trip assembly 204 by a cam 206 mounted to trip assembly 204.

In use, when a short circuit occurs an overcurrent passes through motor protection trip unit 140. More specifically, overcurrent passes through conductive strap 142 to yoke 40 and flapper 42. A magnetic flux is generated in yoke gap 90 (shown in FIG. 2). The magnetic flux increases as the current increases. When a predetermined limit of current is exceeded, the magnetic flux generated is sufficient to attract flapper 42 in opposition to the torsional force exerted by mechanism 190. Flapper 42 pivots towards yoke 40 until flapper 42 actuates cam 206 of trip assembly 204. The actuation of trip assembly 204 actuates latching mechanism 202, which disconnects a contact arm 208 from conductive strap 142 and current flow is prevented and the circuit breaker is tripped.

While the invention has been described in terms of various specific embodiments, those skilled in the art will recognize that the invention can be practiced with modification within the spirit and scope of the claims.

What is claimed is:

1. A motor protection trip unit for a circuit breaker, said trip unit comprising:

an electrically conductive strap;

a yoke comprising a body comprising a first side wall, a second side wall, a third side wall, and a fourth side wall, said third side wall extending between said first and second side walls, said fourth side wall extending from said first and second side walls defining a yoke gap therebetween;

a flapper holder coupled to said strap;

a flapper pivotally coupled to said flapper holder; and a biasing mechanism coupled at one end to said flapper holder and coupled at another end to said flapper, said biasing mechanism configured to maintain said flapper a distance from said yoke such that a yoke-flapper gap is defined between said yoke and said flapper.

2. A trip unit in accordance with claim 1 wherein said trip unit is a magnetic trip unit.

3. A trip unit in accordance with claim 1 wherein said trip unit configured to trip the circuit breaker upon an overcurrent condition.

4. A trip unit in accordance with claim 1 wherein said conductive strap includes a base, a wall, and a plurality of apertures, said wall extending from said base, said apertures extending through said strap.

5. A trip unit in accordance with claim 1 wherein said conductive strap is fabricated from a single plate.

6. A trip unit in accordance with claim 1 wherein said conductive strap comprises a wall coupled to said yoke by at least one of a weld, a screw, and a rivet.

7. A trip unit in accordance with claim 1 wherein said first, second, third, and fourth walls are coupled together to form said yoke.

8. A trip unit in accordance with claim 1 wherein said yoke is substantially rectangular.

9. A trip unit in accordance with claim 1 wherein said flapper holder comprises a base portion coupled to said conductive strap base by at least one of a weld, a screw, and a rivet.

10. A trip unit in accordance with claim 1 wherein said flapper is pivotally coupled to said flapper holder.

11. A trip unit in accordance with claim 1 wherein said flapper comprises a body, a first leg, a second leg, a first pin, and second pin, said first and second legs extending radially from said body, said first and second pins substantially perpendicularly to said respective first and second legs such that a gap is defined between said first and second legs.

12. A trip unit in accordance with claim 11 wherein said first leg and said second leg are coupled to said body, said first pin is coupled to said first leg, and said second pin is coupled to said second leg.

13. A trip unit in accordance with claim 1 wherein said biasing mechanism comprises a spring.

14. A trip unit in accordance with claim 13 wherein said biasing mechanism is biased between said flapper holder and said flapper.

15. A trip unit in accordance with claim 1 wherein said biasing mechanism biased between said flapper and said flapper holder.

16. A circuit breaker comprising:

a motor protection trip unit comprising a yoke, a flapper; and a conductive strap, said trip unit comprising said conductive strap extending therefrom and proximate to said flapper, said flapper and said yoke coupled to said trip unit to define a yoke-flapper gap between said yoke and said flapper, said yoke comprising four side walls defining a yoke gap, said flapper configured to rotate independently of said trip unit to selectively adjust a said yoke-flapper gap;

a contact arm configured to engage said conductive strap;

a latching assembly coupled to said contact arm;

a tripping assembly rotatable about an axis of symmetry and configured to engage said latching mechanism for tripping said circuit breaker during an overcurrent condition.

17. A circuit breaker in accordance with claim 16 wherein said trip assembly comprises a cam said cam coupled to said tripping assembly.

18. A circuit breaker in accordance with claim 16 wherein said trip unit further comprises a biasing mechanism said mechanism configured to bias said flapper away from said yoke.

* * * * *

UNITED STATES PATENT AND TRADEMARK OFFICE

CERTIFICATE OF CORRECTION

PATENT NO. : 6,744,339 B2
DATED : June 1, 2004
INVENTOR(S) : Daehler et al.

It is certified that error appears in the above-identified patent and that said Letters Patent is hereby corrected as shown below:

Column 5,
Line 2, after "unit" insert -- is --.

Column 6,
Line 17, after "selectively adjust" delete "a".

Signed and Sealed this

Twenty-seventh Day of December, 2005

JON W. DUDAS
*Director of the United States Patent and Trademark Office*